US010044107B2

(12) United States Patent
Elliot et al.

(10) Patent No.: US 10,044,107 B2
(45) Date of Patent: Aug. 7, 2018

(54) MULTI-BAND HELICAL ANTENNA SYSTEM

(71) Applicant: The MITRE Corporation, McLean, VA (US)

(72) Inventors: Paul Gordon Elliot, Acton, MA (US); Eddie Nelson Rosario, Methuen, MA (US)

(73) Assignee: The MITRE Corporation, McLean, VA (US)

( * ) Notice: Subject to any disclaimer, the term of this patent is extended or adjusted under 35 U.S.C. 154(b) by 0 days.

(21) Appl. No.: 15/447,635

(22) Filed: Mar. 2, 2017

(65) Prior Publication Data

US 2017/0179606 A1 Jun. 22, 2017

Related U.S. Application Data

(62) Division of application No. 13/653,763, filed on Oct. 17, 2012, now Pat. No. 9,614,293.

(51) Int. Cl.
*H01Q 11/08* (2006.01)
*H01Q 21/28* (2006.01)

(52) U.S. Cl.
CPC ..... *H01Q 11/08* (2013.01); *H01Q 21/28* (2013.01)

(58) Field of Classification Search
CPC ..... H01Q 11/08; H01Q 21/28; H01Q 21/30
See application file for complete search history.

(56) References Cited

U.S. PATENT DOCUMENTS 6,072,441 A 6/2000 Tanabe
6,094,178 A 7/2000 Sanford
6,133,891 A 10/2000 Josypenko
6,181,286 B1 1/2001 Roscoe et al.
6,278,414 B1 8/2001 Filipovic
6,334,048 B1 12/2001 Edvardsson et al.
6,407,720 B1 6/2002 Josypenko
6,483,471 B1 11/2002 Petros
6,621,458 B1 9/2003 Petros et al.
6,653,987 B1 11/2003 Lamensdorf et al.
6,720,935 B2 4/2004 Lamensdorf et al.
6,812,906 B2 11/2004 Goldstein et al.
7,525,508 B2 4/2009 Sharaiha et al.
2006/0125712 A1 6/2006 Sharaiha et al.
2014/0139384 A1 5/2014 Elliot et al.

OTHER PUBLICATIONS

Bhandari, B. et al., "Meandered Variable Pitch Angle Printed Quadrifilar Helix Antenna," *2009 Loughborough Antenna & Propagation Conference*, UK, pp. 325-328 (Nov. 16-17, 2009).
Chen, T.T., "Dipoles and Monopoles," in *Antenna Engineering Handbook*, Second Edition, R.C. Johnson, H. Jasik (eds.), McGraw-Hill Book Co., Chapter 4: pp. 4-4-4-34 (1984).
(Continued)

*Primary Examiner* — Robert Karacsony
(74) *Attorney, Agent, or Firm* — Sterne, Kessler, Goldstein & Fox, PLLC

(57) ABSTRACT

A multi-use antenna system that can be used in, for example, integrated communications and navigation capability is provided. In an embodiment, an antenna system is provided. The antenna system includes a first antenna having a plurality of radiating elements substantially wrapped around an axis and a second antenna located within the first antenna. The first and second antennas are coupled to the same ground plane and are configured to operate in different frequency bands.

20 Claims, 16 Drawing Sheets

(56) References Cited

OTHER PUBLICATIONS

Lamensdorf, D. et al., "Dual-Band Quadrifilar Helix Antenna," *IEEE Antennas and Propagation Society International Symposium 2002*, vol. 3, San Antonio, Texas, pp. 488-491 (Jun. 16-21, 2002).
Letestu, Y. et al., "Broadband Folded Printed Quadrifilar Helical Antenna," *IEEE Transactions on Antennas and Propagation*, vol. 54, No. 5, pp. 1600-1604 (May 2006).
McCarrick, C.D., "A Combination Monopole/Quadrifilar Helm Antenna for S-band Terrestrial Satellite Applications," *Microwave Journal*, vol. 44, No. 5, pp. 330-334 (May 1, 2001).
Rabemanantsoa, J., et al., "Small-folded, Printed Quadrifilar Helix Antenna for GPS Applications," *2010 14th International Symposium on Antenna Technology and Applied Electromagnetic* (*ANTEM*) *and the American Electromagnetics Conference* (*AMEREM*), 4 pages, IEEE (2010).
Rama-Rao, B. et al., "Ferrite Loaded UHF Sleeve Monopole Integrated with a GPS Patch Antenna for a Handset," *Microwave and Optical Technology Letters*, vol. 54, No. 11, pp. 2513-2516 ( Nov. 2012).
Rabemanantsoa, J. et al., "Size Reduced Multi-Band Printed Quadrifilar Helical Antenna," IEEE Transactions on Antennas and Propagation, vol. 59, No. 9, Sep. 2011, pp. 3138-3134 (6 pages).

MULTI-BAND HELICAL ANTENNA SYSTEM

CROSS REFERENCE TO RELATED APPLICATION

This application is a divisional of U.S. patent application Ser. No. 13/653,763, filed Oct. 17, 2012, which is hereby incorporated by reference in its entirety.

STATEMENT REGARDING FEDERALLY-SPONSORED RESEARCH AND DEVELOPMENT

Statement under M.P.E.P. § 310. The U.S. government has a paid-up license in this invention and the right in limited circumstances to require the patent owner to license others on reasonable terms as provided for by the terms of Contract FA8721-11-C-0001 awarded by the United States Air Force Global Positioning Directorate.

Part of the work performed during development of this invention utilized U.S. Government funds. The U.S. Government has certain rights in this invention.

BACKGROUND

Field

Embodiments described herein generally relate to antennas capable of communication and navigation using multiple frequency bands.

Background

Satellite communication and navigation systems can be used to provide a broad set of services, e.g., Global Navigation Satellite System (GNSS), which includes Global Positioning System (GPS). To be able to transmit or receive from satellites, handsets used in these systems often use circularly polarized antennas because circularly polarized radiation is generally insensitive to ionospheric polarization rotation. Moreover, these antennas preferably are also able to provide gain from zenith down to near the horizon to allow for communications with low elevation angle satellites.

Helical antennas are one example of a type of antennas that are often used for handsets in satellite communication or navigation systems. For example, a quadrifilar helical antenna (QHA) can be used to provide right-handed circularly polarized (RCHP) gain at angles from zenith down to the horizon. Further enhancing their appeal, QHAs are generally small, light-weight, and cheap to fabricate.

A QHA includes four arms wrapped around a cylindrical surface, for example the surface of a dielectric rod. Each of the arms can be formed out of a copper trace and each can be separately fed at the base of the antenna. To enhance its bandwidth, a QHA can be provided with four pairs of arms (termed a "folded QHA"). In each pair, one arm (termed the "driven arm") is connected to a feed point which is connected to the circuit and electronics which sends and/or receives signals to or from the antenna. The other arm, termed the ("folded arm"), provides an extension of the driven arm and/or a return path for the current.

Although conventional QHAs provide RHCP gain over a wide range of angles, their frequency bandwidth is often limited. For example, many conventional QHAs only can operate at one or two GNSS frequency bands. This is not sufficient for many new GNSS systems which use additional GNSS bands. Moreover, some communication systems use different frequency bands at which conventional GNSS QHAs are not operational, e.g., the frequency bands used for Iridium and for UHF communications.

BRIEF SUMMARY

A multi-use antenna system that can be used for example, integrated communications and navigation capability is provided. In an embodiment, an antenna system is provided. The antenna system includes a first antenna having a plurality of radiating elements substantially wrapped around an axis and a second antenna located within the first antenna. The first and second antennas are coupled to the same ground plane and are configured to operate in different frequency bands.

In another embodiment, an antenna is provided. The antenna includes a rod (e.g., made of dielectric or foam) and a plurality of radiating elements helically wrapped around the rod. Each of the radiating arms comprises a driven arm, a folded arm, and a capacitance that couples respective driven and folded arms.

In still another embodiment, an antenna is provided. The antenna includes a rod and first and second radiating elements helically wrapped around the dielectric rod, wherein the first radiating element is shorted to the second radiating element.

These and other advantages and features will become readily apparent in view of the following detailed description of the invention. Note that the Summary and Abstract sections may set forth one or more, but not all exemplary embodiments of the present invention as contemplated by the inventor(s).

BRIEF DESCRIPTION OF THE DRAWINGS/FIGURES

The accompanying drawings, which are incorporated herein and form a part of the specification, illustrate the present invention and, together with the description, further serve to explain the principles of the invention and to enable a person skilled in the pertinent art to make and use the invention.

Figure 1A:
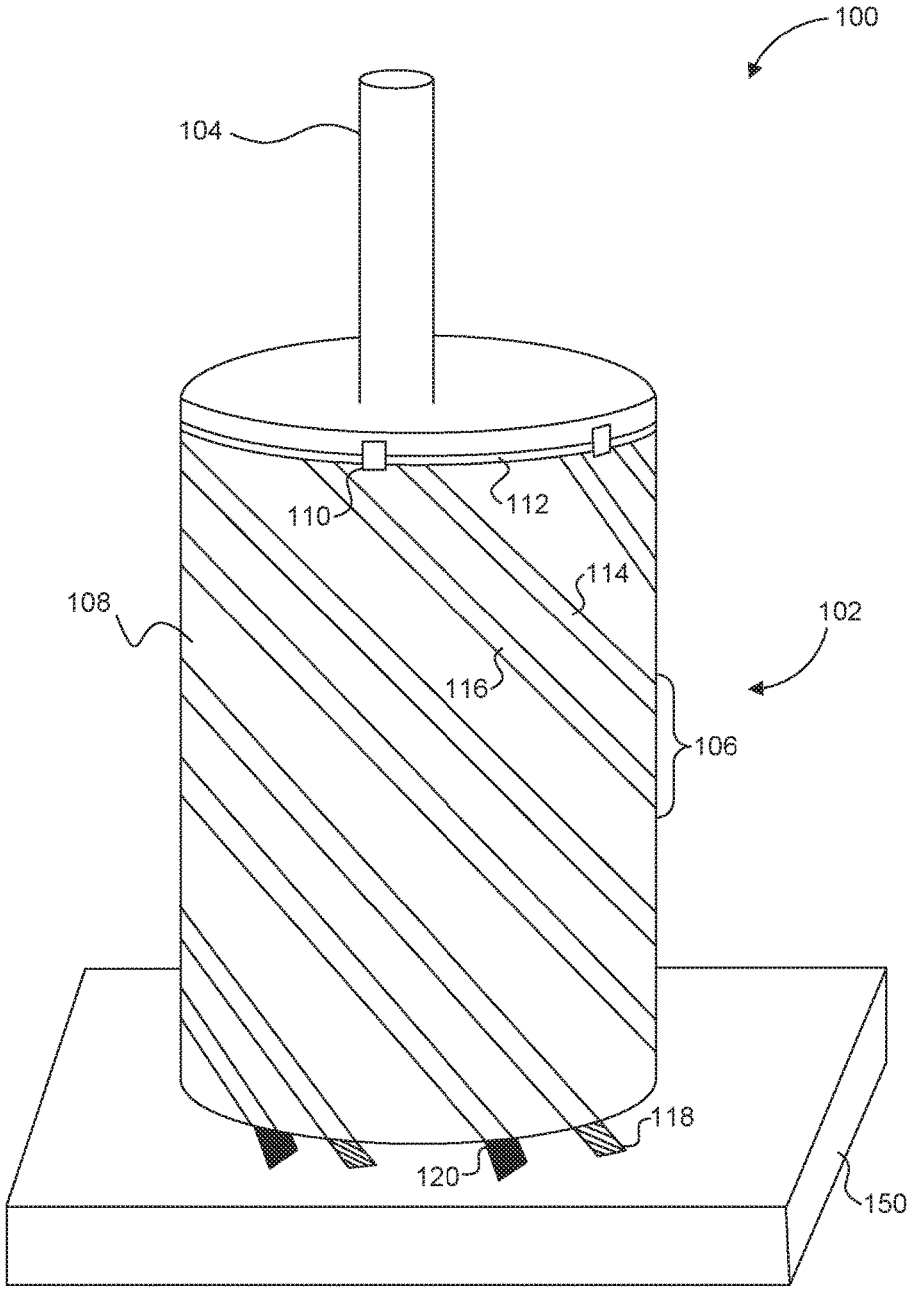
FIGS. 1A and 1B show perspective views of antenna system.

The present invention will now be described with reference to the accompanying drawings. In the drawings, like reference numbers indicate identical or functionally similar elements. Additionally, the left-most digit(s) of a reference number identifies the drawing in which the reference number first appears.

DETAILED DESCRIPTION

I. Introduction

Embodiments described herein include an antenna system that can be used in integrated communications and navigation (Comm/Nav). For example, an antenna system can include first and second antennas that share the same ground plane. The first antenna can be a helical antenna that includes a plurality of radiating elements wrapped around an axis. For example, the first antenna can be a folded QHA antenna including four radiating elements wrapped around a dielectric rod.

In a further embodiment, the first antenna can include components that improve its performance. For example, the first antenna can include a capacitance that couples different arms of its radiating elements. Additionally or alternatively, first antenna includes radiating elements that are each shorted to adjacent radiating elements.

The second antenna can be a monopole, sleeve monopole, dipole, or other antenna. For example, the second antenna can be co-located with the first antenna. Specifically, the second antenna can be located within the first antenna. In one embodiment, the second antenna is located in an axial opening formed in a dielectric rod of the first antenna.

In an embodiment, the first antenna improves the performance of the second antenna. For example, the first antenna can improve an impedance matching of the second antenna. Additionally, by co-locating the first and second antennas, the area required to install them on a transceiver is reduced.

In an embodiment, the first antenna can be configured to operate in Global Navigation Satellite System (GNSS) and Iridium frequency bands. The second antenna can be configured to operate in the Ultra High Frequency (UHF) band. Thus, the antenna system operates in both GNSS and Iridium satellite communication bands and the UHF 225-512 MHz communication band. The GNSS frequencies covered by the first antenna include modernized GPS (L1, L2, L5), GLONASS, Galileo, and Beidou (Compass), spanning from 1164 to 1300 MHz and 1559 to 1611 MHz. The Iridium communications transmit and receive band (1611-1626 MHz) is also covered.

Moreover, antennas according to the above embodiments also satisfy requirements imposed on handsets used in satellite communications. For example, in the embodiment in which the first antenna is a QHA, the first antenna provides right-hand circularly polarized (RHCP) radiation at all GNSS and Iridium frequencies at angles from zenith down to 10 degrees above the horizon. A QHA is well suited for this task because it provides excellent RHCP coverage at all azimuth and elevation angles, as well as low crosspolarization to reduce multipath effects.

II. Antenna Structure

FIG. 1A shows a perspective view of an antenna system 100, according to an embodiment. As shown in FIG. 1A, antenna system 100 includes a first antenna 102, and a second antenna 104. Antenna system 100 is situated on top of a handset box 150. In alternate embodiments, antenna system 100 can be located at different locations of handset box 150, e.g., bottom of handset box 150. The best performance for antenna system 100 may, however, come when antenna system 100 is located on the top of handset box 150 because satellites are typically situated in the upper hemisphere relative to the handset.

In an embodiment, first and second antennas 102 and 104 share a common ground plane. For example, in FIG. 1A, the top surface of handset box 150 provides a common ground plane for first and second antennas 102 and 104.

First antenna 102 is a QHA including four radiating elements 106. Radiating elements 106 are helically wrapped around a surface or a foam cylinder or dielectric rod 108. In an embodiment, 108 can be a dielectric rod or in another embodiment 108 can be a foam rod or a cylinder.

As shown in FIG. 1A, second antenna 104 is a monopole antenna. Second antenna 104 is located in an axial opening of first antenna 102. In an embodiment, second antenna 104 can be configured to communicate in the UHF band (225-512 MHz).

Each of radiating elements 106 includes a capacitance 110, a short-circuit 112, a driven arm 114, and a folded arm 116. In an embodiment, capacitance 110, short-circuit 112, driven arm 114 and folded arm 116 can be formed out of metallic traces, e.g., copper traces. For example, traces can be made from copper tape placed on a thin Mylar sheet that is compatible with printed-circuit volume production. The Mylar can be wrapped around a dielectric or foam rod which fills the volume inside the helix.

Those skilled in the art will appreciate that first antenna 102 can be implemented as another type of helical antenna without departing from the scope and spirit of the present invention. For example, first antenna 102 can be implemented as a bifilar helical antenna, which has two radiating elements (instead of a QHA which has four radiating elements).

In some conventional QHAs (termed a "folded QHA"), the driven and folded arms of each radiating element are shorted together. The folded arms serve to provide an extension of the radiating element or a return path for current. In contrast to conventional folded QHAs, however, first antenna 102 has each respective driven arm 114 is coupled to its respective folded arm 116 through a respective capacitance 110. In the embodiment of FIG. 1A, folded arms 116 still provide return paths for current, but simulation and measurement results have shown that the added capacitance improves the bandwidth of first antenna 102.

Moreover, in conventional folded QHAs, the different radiating elements are electrically isolated. That is, each radiating element in a conventional QHA is electrically isolated from adjacent radiating element. In contrast, in first antenna 102, each radiating element 106 is electrically coupled to adjacent ones of radiating elements 106. Specifically, as shown in FIG. 1A, folded arm 116 of each radiating element 106 is short-circuited using a respective short 112 to driven arm 114 of the neighboring radiating element 106. Simulation and measurement results have shown that short-circuits 112 enhance the bandwidth of first antenna 102.

Furthermore, those skilled in the art will appreciate that when two antennas are brought in close proximity to each other, the radiating capabilities of both antennas are typically diminished. In antenna system 100, however, the presence of first antenna 102 instead enhances the bandwidth properties of second antenna 104. For example, and as described below in greater detail, the presence of first antenna 102 can improve the impedance match and impedance bandwidth for second antenna 104. As a result, second antenna 104 radiates a larger percentage of its transmitter power and receives a greater percentage of its incident power, thereby increasing the gain and bandwidth of the second antenna 104.

Each of driven arms 114 are fed from respective feed points 118. In an embodiment, feed points 118 are 50-ohm feed points. Moreover, each of feed points 118 can be externally phased in quadrature for RHCP radiation. Each of folded arms 116 is grounded. For example, as shown in FIG.

1A, connections 120 electrically couple respective folded arms 116 to handset frame 150.

Figure 1B:
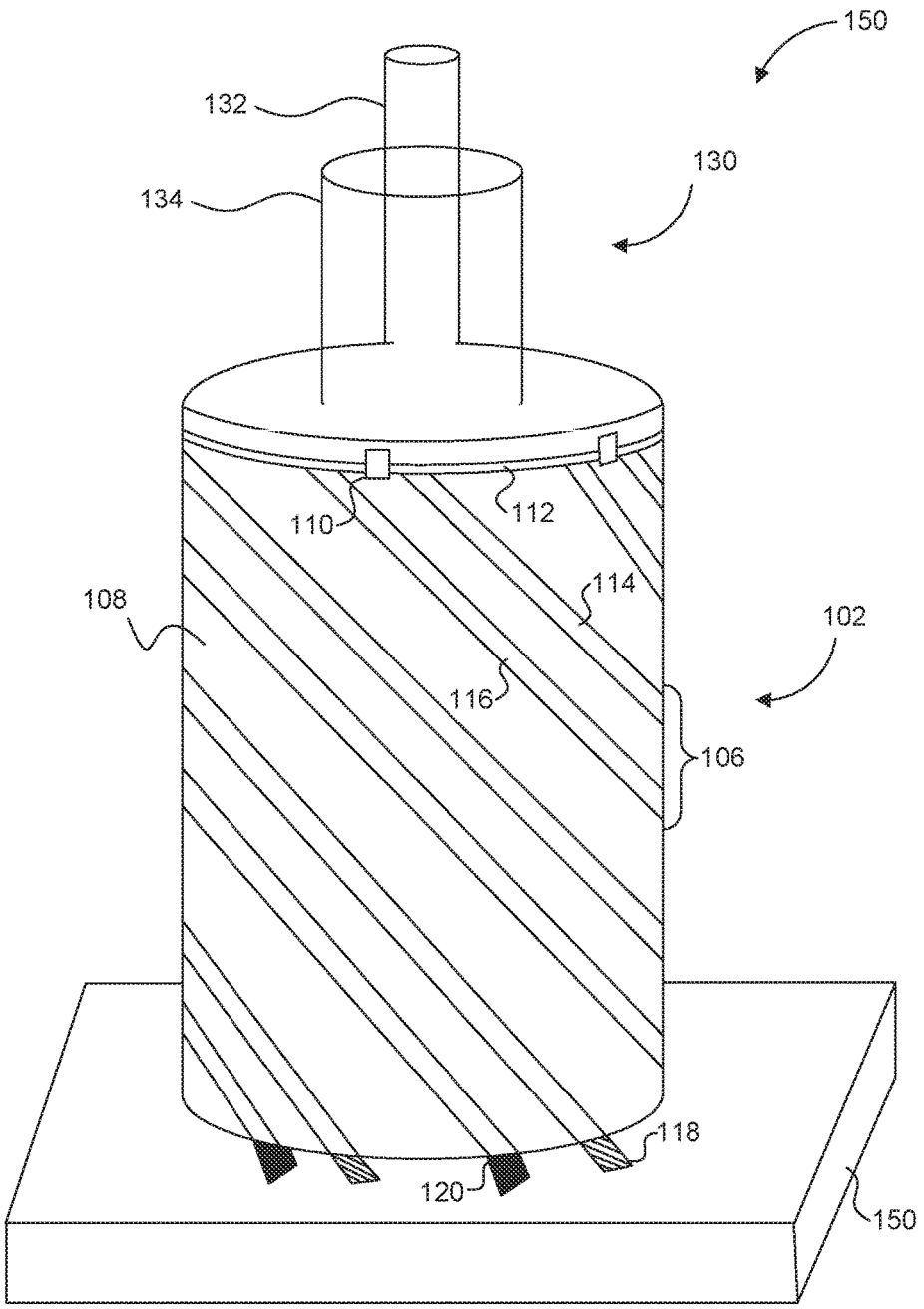
Figure 2A:
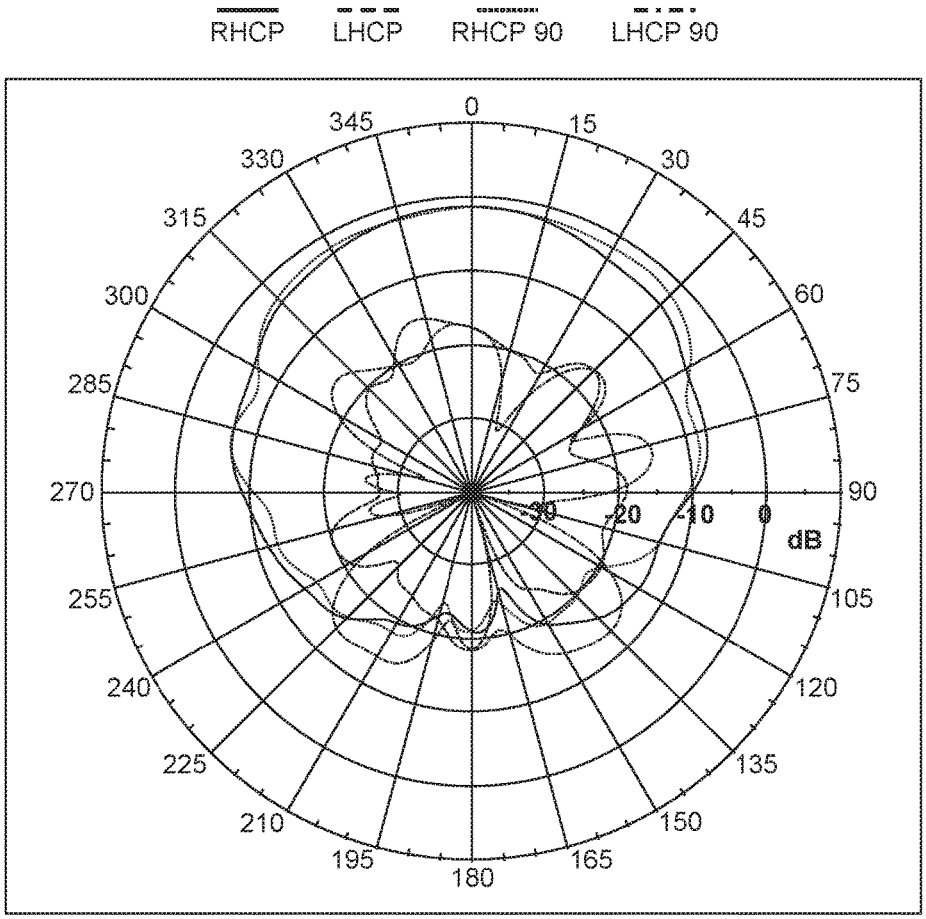
FIGS. 2A-2D show measured circularly polarized gain patterns of a first antenna in two orthogonal planes, according to an embodiment.
Figure 2B:
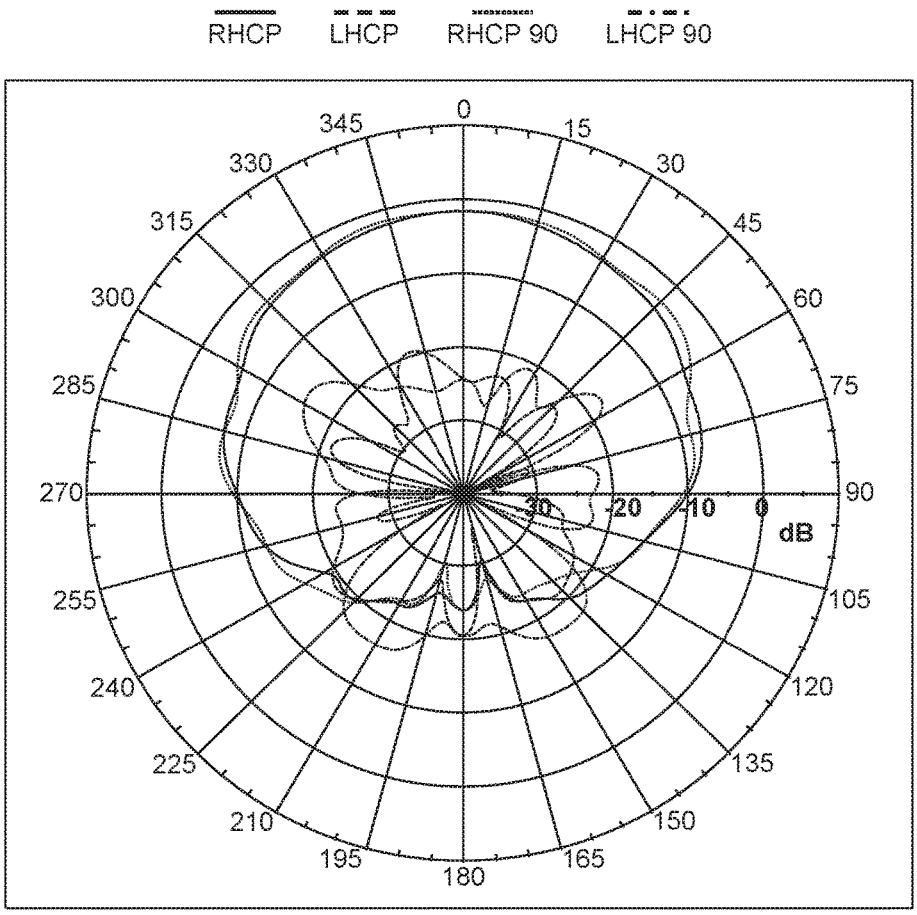
Figure 2C:
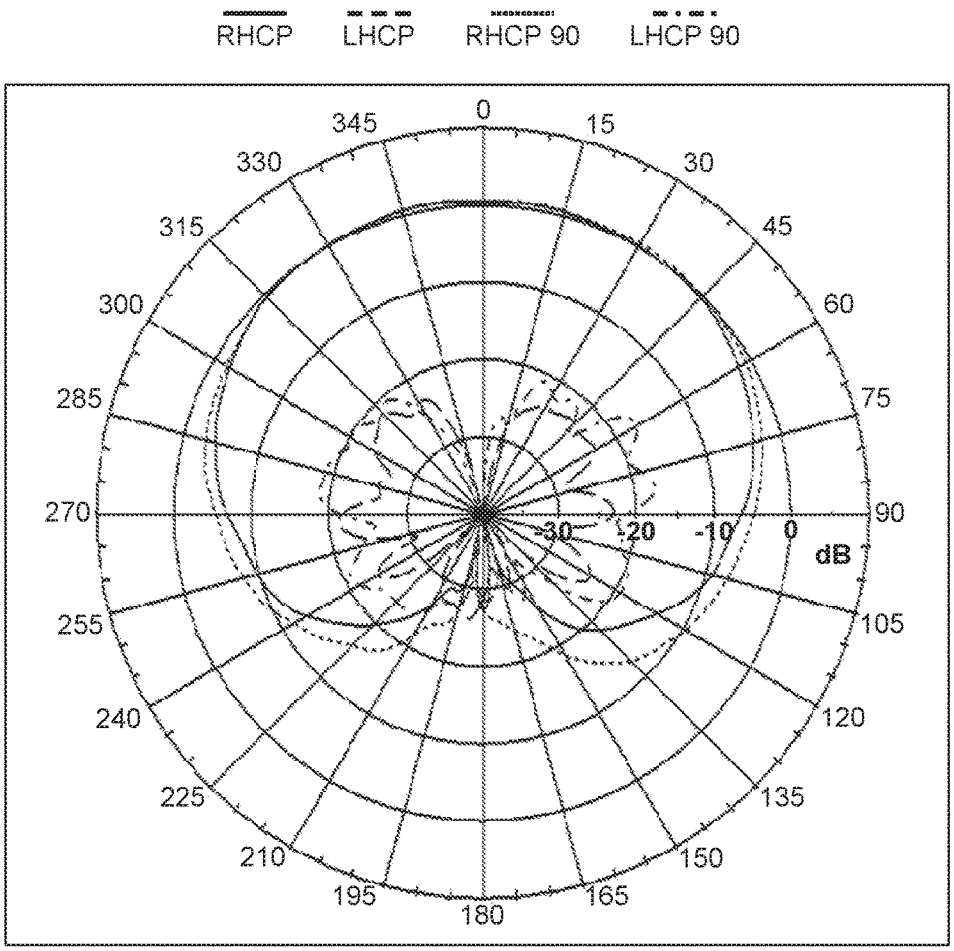
Figure 2D:
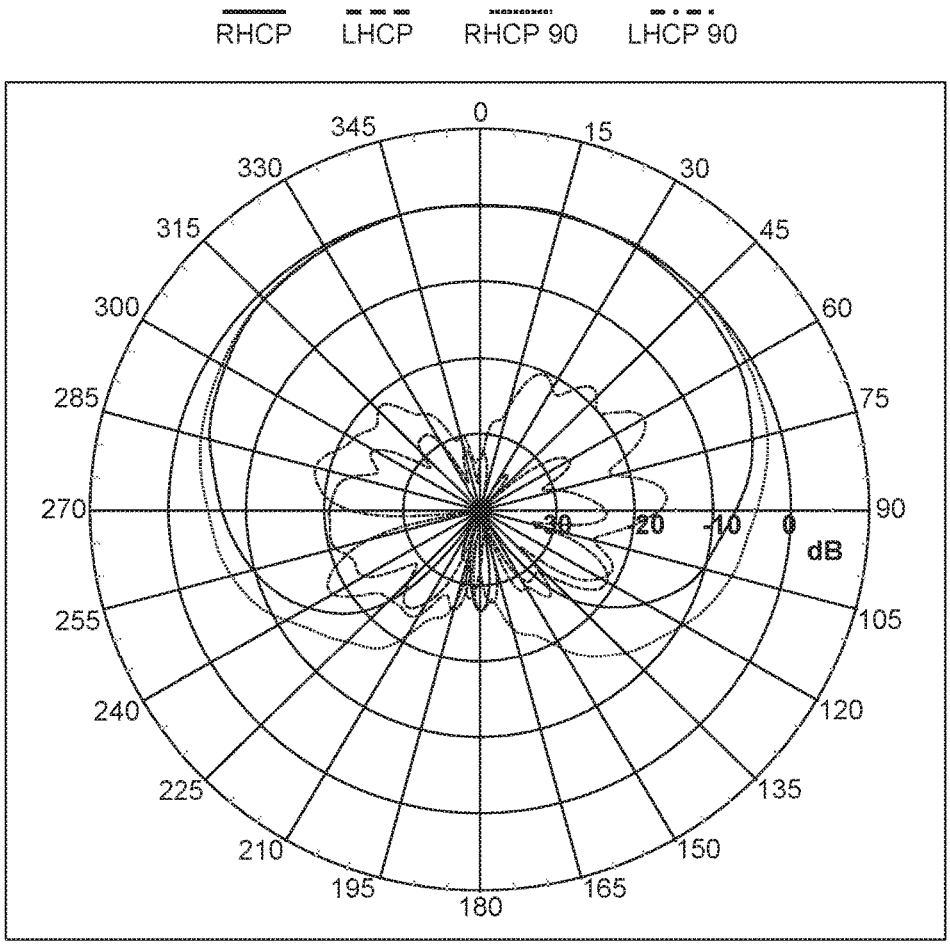

FIG. 1B shows an antenna system 150, according to an embodiment. Antenna system 150 is substantially similar to antenna system 100, except that second antenna 104 is replaced with second antenna 130. Second antenna 130 is a sleeve monopole antenna that includes a radiating element 132 surrounded by a metallic sleeve 134.

As would be appreciated by those skilled in the art based on the description herein, different types of antennas can be co-located with first antenna 102 without departing from the scope and spirit of the present invention. For example, in addition to the examples provided above, second antenna 104 can be implemented as a dipole antenna.

III. Exemplary Implementations

Tables I and II, shown below, list dimensions and parameters for exemplary implementations of antenna systems according to embodiments. In Table I, both QHAs were implemented using a foam dielectric rod having a relative permittivity ($\varepsilon_r$) of 1.07. In Table II, both QHAs were implemented using a dielectric rod having a relative permittivity of 4.

TABLE I

Dielectric Rod is Rohacell Foam with Relative Permittivity $\varepsilon_r$ = 1.07

| a. Name | b. QHA Diameter | c. QHA Helix Axial Length | d. UHF Brass Monopole Diameter | e. Helix Pitch | f. Helix Pitch Angle α | g. Degrees Rotation Folded Arm ϕ | h. Number of turns for each helix | i. Helix Trace Length, wvlgth | j. Helix Trace Width |
|---|---|---|---|---|---|---|---|---|---|
| Antenna A Air-loaded 1.5" x 2.9" | 38.1 mm (1.50") | 74 mm (2.913") | 25.4 mm (1.00") | 98.3 mm (3.870") | 39.2° | 24° | 0.753 | 0.547 $\lambda_o$ | 2 mm (0.079") |
| Antenna B Air-loaded 1.0" × 3.2" | 24.5 mm (1.00") | 81 mm (3.189") | 3.2 mm (0.125") | 84.8 mm (3.338") | 46.4° | 24° | 0.955 | 0.522 $\lambda_o$ | 2 mm (0.079") |

TABLE II

Dielectric Rod is EccoStock HiK with Relative Permittivity $\varepsilon_r$ = 4.0

| a. Name | b. QHA Diameter | c. QHA Helix Axial Length | d. UHF Brass Monopole Diameter | e. Helix Pitch | f. Helix Pitch Angle α | g. Degrees Rotation Folded Arm ϕ | h. Number of turns for each helix | i. Helix Trace Length, wvlgth | j. Helix Trace Width |
|---|---|---|---|---|---|---|---|---|---|
| Antenna C Diel-loaded 1.0" × 2.2" | 24.5 mm (1.00") | 57 mm (2.244") | 3.2 mm (0.125") | 78.8 mm (3.103") | 44.3° | 25° | 0.723 | 0.381 $\lambda_o$ | 0.5 mm (0.020") |
| Antenna D Diel-loaded 0.75"x 2.4" | 19.05 mm (0.75") | 62 mm (2.441") | 3.2 mm (0.125") | 66.8 (2.631") | 47.7° | 30° | 0.928 | 0.391 $\lambda_o$ | 0.5 mm (0.020") |

In Tables I and II, column (e) provides the Helix Pitch, which is the axial length if the helix were extended for 1 full turn (the helix is less than 1 full turn). Column (f) provides the Helix Pitch Angle, α, which is the slope of helix trace measured from horizontal. Column (g) provides the Degrees of Rotation to Folded Arm, ϕ, which is the circumferential angle about the center axis of the helix separating the driven helix arm from the folded arm measured center to center of the traces (also shown in FIG. 1A). Column i is the Helix Trace Length in wavelengths. This can be determined as which is the length along each driven arm as it winds around, from the feed point at the bottom, up to the top of the helix, divided by the free-space wavelength at 1.4 GHz (which is the approximate center of the GNSS frequency band). Column (j) is the Helix Trace Width of the copper trace used for each helix arm. The inventor has found that a trace width as narrow as 0.5 mm (0.020") can improve performance for QHAs.

IV. Experimental Results

The two QHAs in Table I (antennas A and B) were built and tested. Each used a Rohacell foam dielectric material with a relatively low dielectric constant (i.e., $\varepsilon_r$=1.07). Thus, each is approximately air-loaded. The QHAs were externally phased for RHCP radiation using a combination network including two quadrature hybrids and one 180 hybrid. The loss through this combiner network is approximately 2 dB, which is incorporated in the measured gains and patterns in the figures and described below.

The antenna patterns and gain are affected by the transceiver handset box upon which the antenna is mounted. In testing, the antennas were optimized and tested on a conductive handset box which is 203 mm×102 mm×38 mm (8" long×4" wide by 1.5" thick). No other ground plane was used. The diameter of the QHAs ranged from 19 mm to 38 mm (0.75" to 1.5") so they can fit on top of the handset. A 254 mm (10") long UHF monopole or sleeve was included co-axially through the center of each QHA.

A. Antenna A of Table I.

As noted in Table I, the antenna A is 38.1 mm wide by 74 mm long (1.5"×2.9"), so it does not exceed the 38.1 mm (1.5") thickness of the handset case. It encircles a 25.4 mm (1") diameter, 254 mm (10") long metal cylinder. For example, the long metal cylinder can be a UHF sleeve monopole, e.g. a UHF sleeve monopole as described in Rama-Rao, B. et al., *Ferrite Loaded UHF Sleeve Monopole Integrated with a GPS Patch Antenna for a Handset,* in Microwave and Optical Technology Letters, Vol. 54, No. 11, pp. 2513-16, November 2012, which is incorporated herein in its entirety. The bottom of the UHF sleeve is soldered to the handset.

The measured circularly polarized gain patterns of antenna A of Table I in two orthogonal planes are shown in FIGS. 2A-2D. The patterns in FIGS. 2A-2D are plotted versus Theta which is the angle measured from zenith. Theta is shown around the periphery of FIGS. 2A-2D. The "RHCP" curve is "Right Hand Circular Polarization," which is the desired polarization. "LHCP is "Left Hand Circular Polarization," which is the cross-polarization or undesired polarization. "RHCP 90" and "LHCP 90" are the patterns in the orthogonal plane, which is rotated 90 degrees in azimuth from the first plane.

Figure 3:
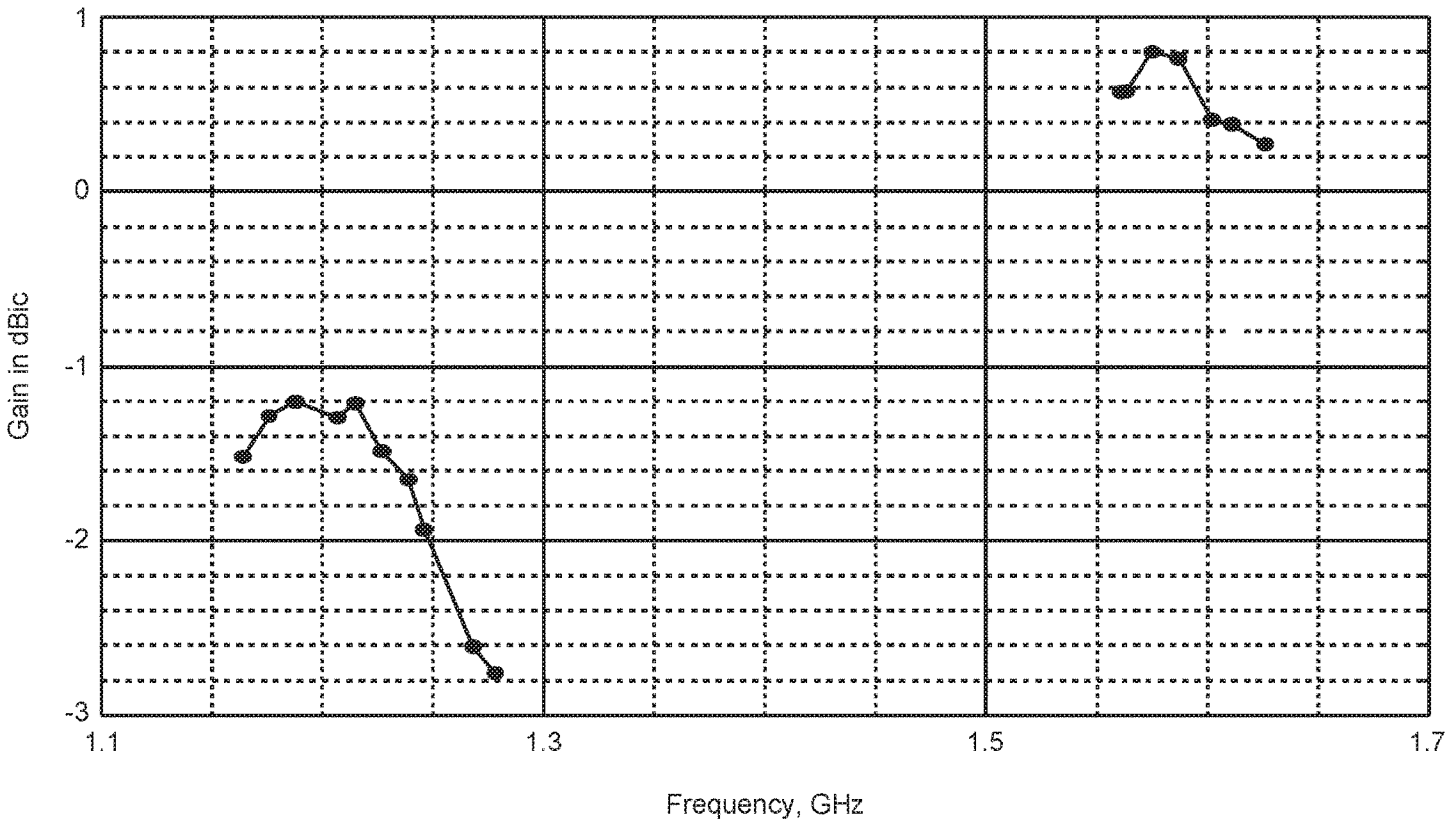
FIG. 3 shows gain at zenith for all GNSS and Iridium frequencies for the first antenna, according to an embodiment.
Figure 4:
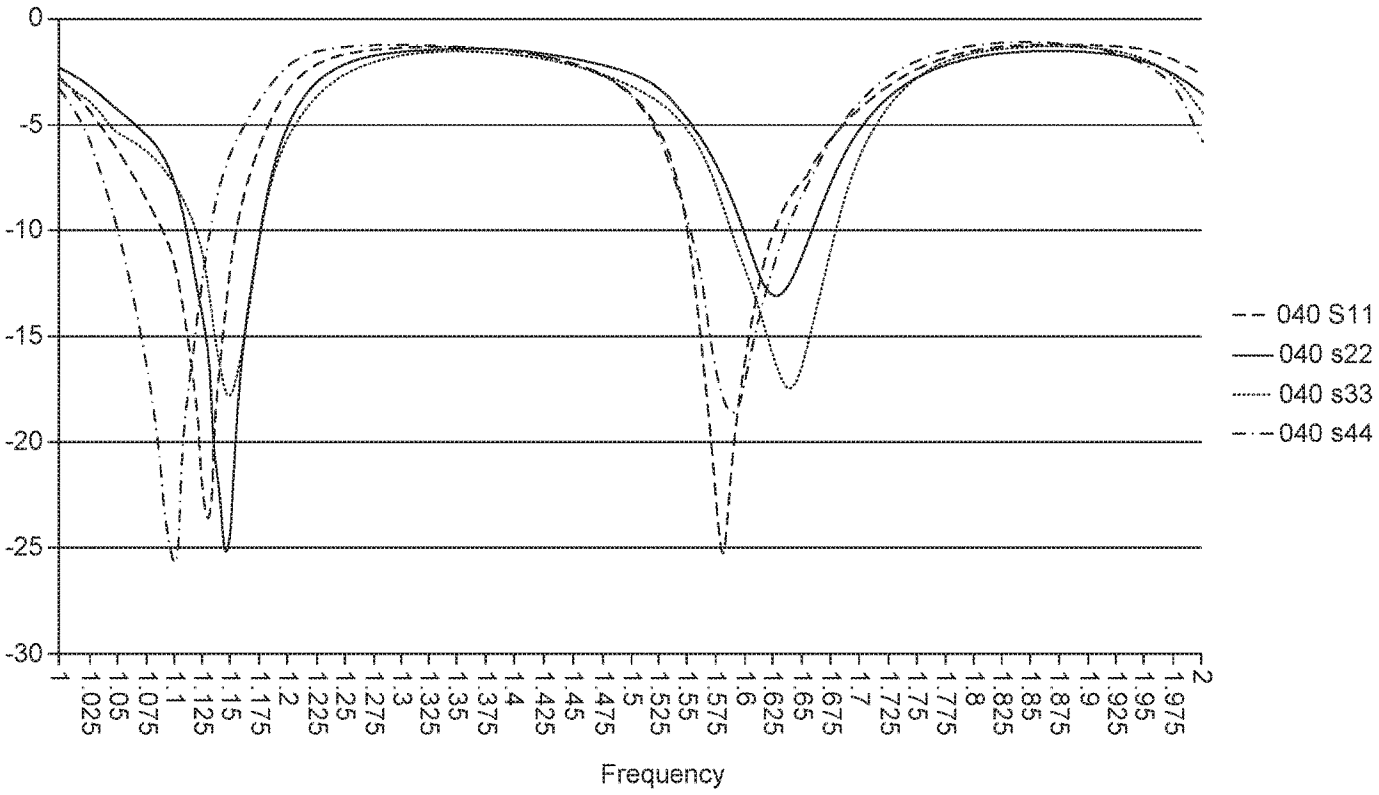
FIG. 4 shows measured return loss (Snm) at each input port of the first antenna, according to an embodiment.
Figure 5A:
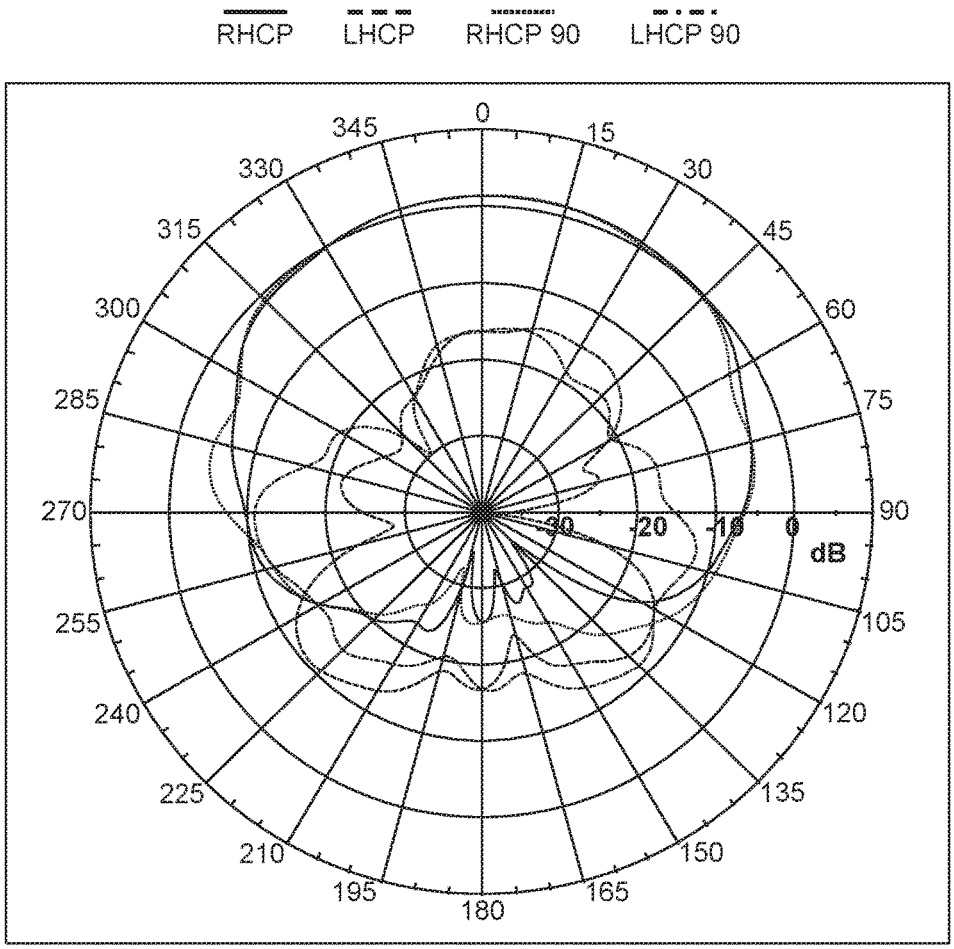
FIGS. 5A-5D show measured circularly polarized gain patterns of a first antenna in two orthogonal planes, according to an embodiment.
Figure 5B:
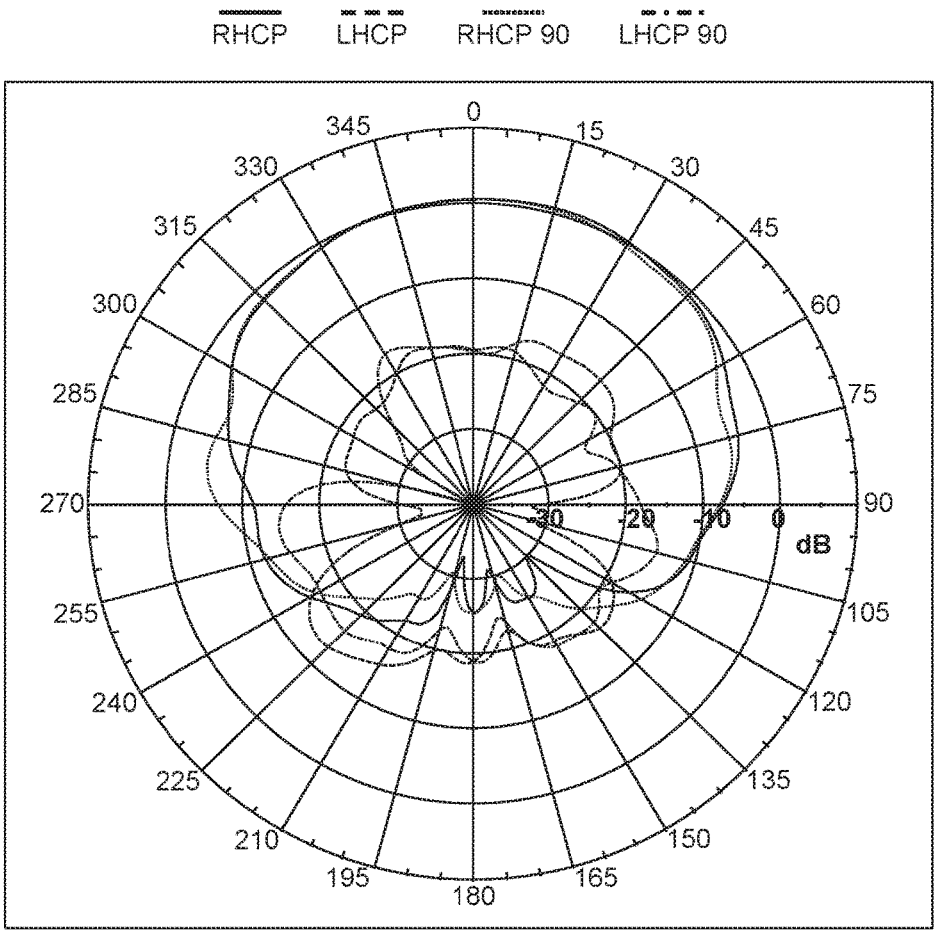
Figure 5C:
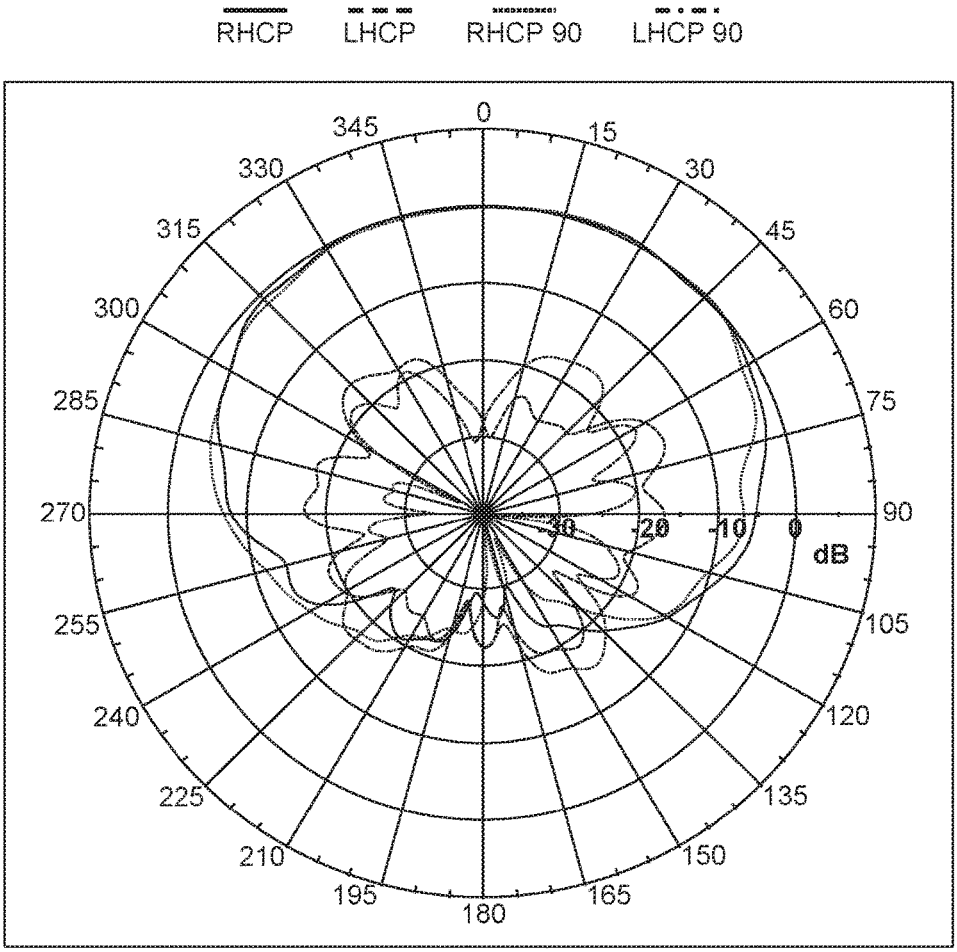
Figure 5D:
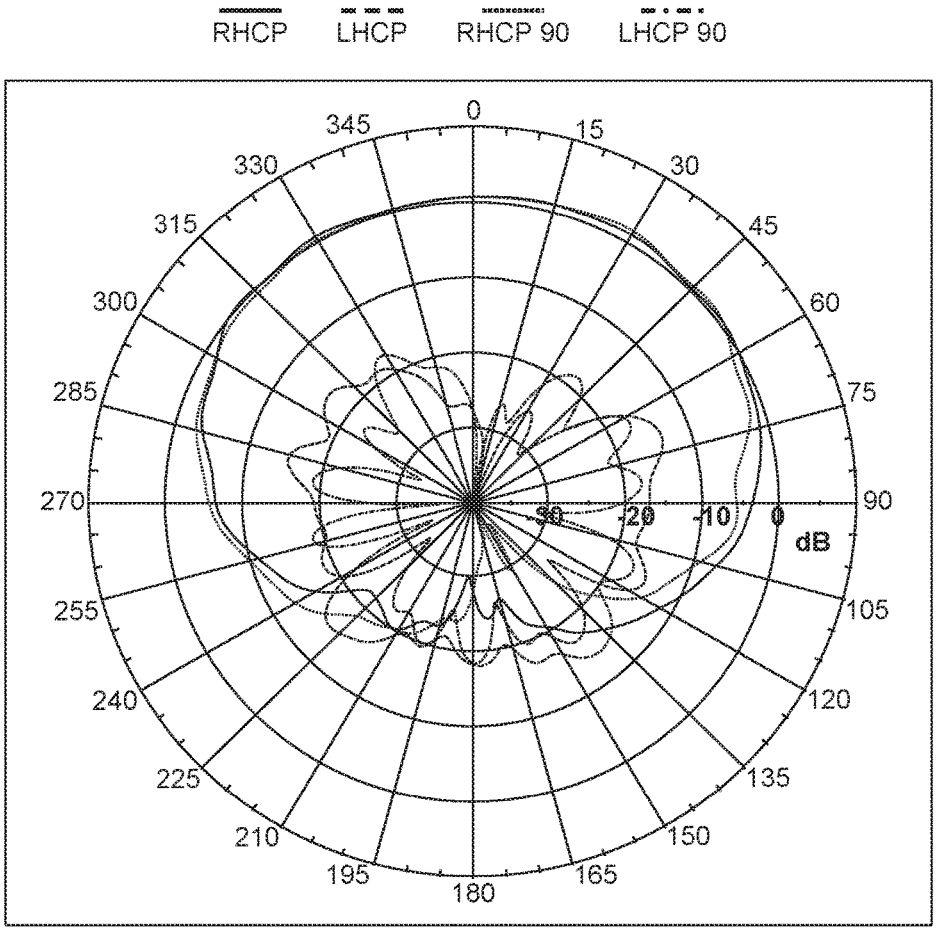

FIG. 3 shows the gain at zenith for all GNSS and Iridium frequencies. The measured zenith gain at L1 is 0.8 dBic and at Iridium it is 0.3 dBic. At L2 and L5 the gain is approximately −1.4 dBic. FIG. 4 shows the Return Loss (S11) at each input port for antenna A. FIG. 4 shows a dual-band very low return loss, which indicates a satisfactory impedance match. The measured crosspolarization level for all the QHAs was to be approximately -20 dBic. The low-angle coverage was approximately −5 dBic at 10 degrees elevation, which is better than most other types of fixed reception pattern antennas (FRPAs). As shown in FIGS. 2A-2D, there is relatively high gain, especially at low elevation angles, even with the presence of the wide diameter UHF sleeve antenna within antenna A. Increasing the diameter of the UHF sleeve still further was found to reduce the gain of the constant width antenna.

FIG. 4 shows the measured return loss (Snm) at each input port of antenna A. The individual port S11 resonances shown in FIG. 4 do not always occur at exactly the same frequencies as the maximum gain shown in FIG. 3. This may be because of mutual coupling between the four feed ports of the QHA which will affect the impedance and return loss when all four ports are driven simultaneously for RHCP.

B. Antenna B of Table I.

Antenna B in Table I has the same topology as antenna A, but the diameter is smaller because the inserted monopole is thinner (as shown in column d of Table I). Antenna B is 25.4 mm (1.0") wide by 81 mm (3.2") long. It encircles a thin monopole which is 3.2 mm (0.125") diameter and 254 mm (10") long.

Figure 6:
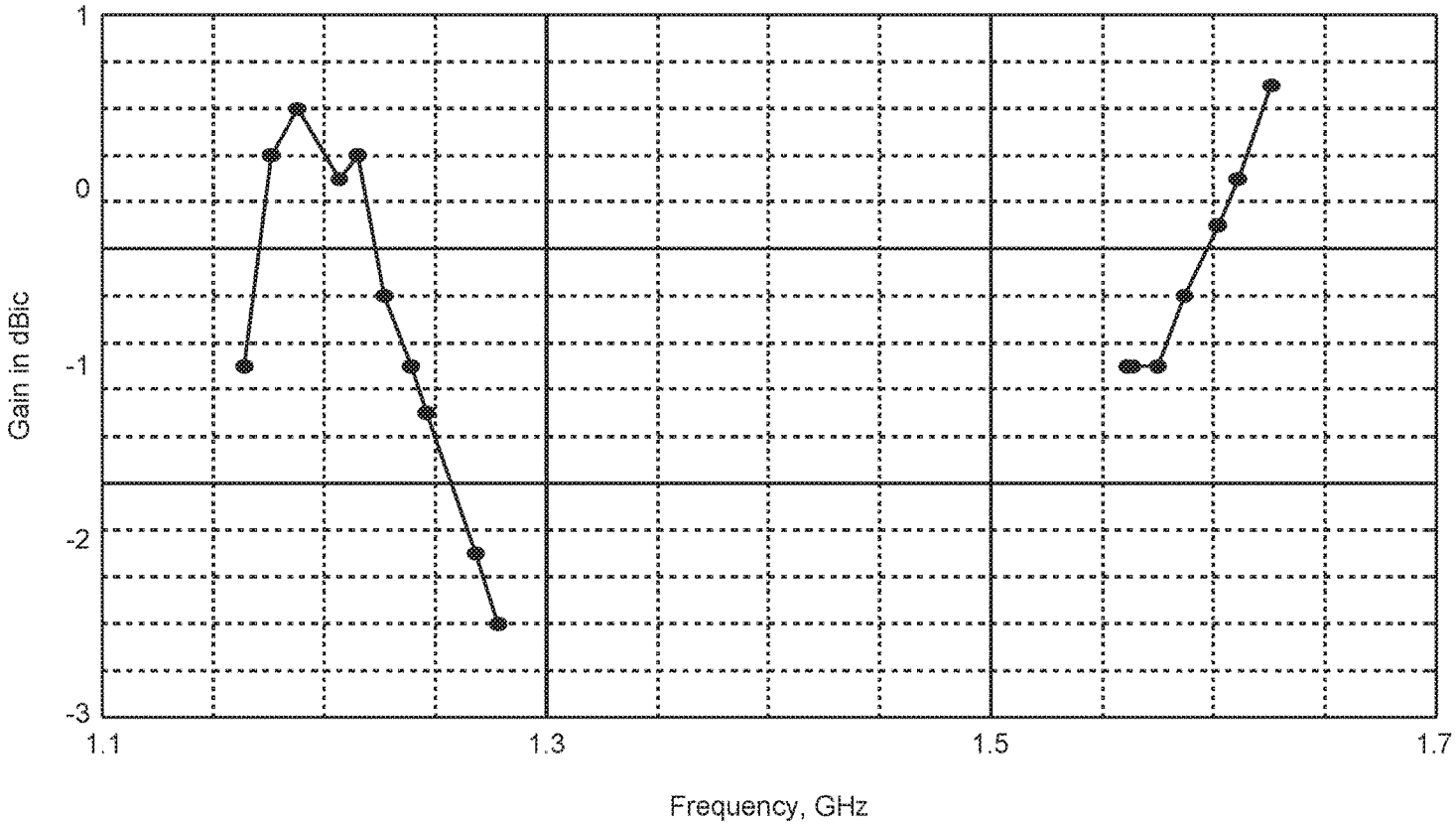
FIG. 6 shows an example gain for the first antenna at zenith for all GNSS and Iridium frequencies, according to an embodiment.
Figure 7:
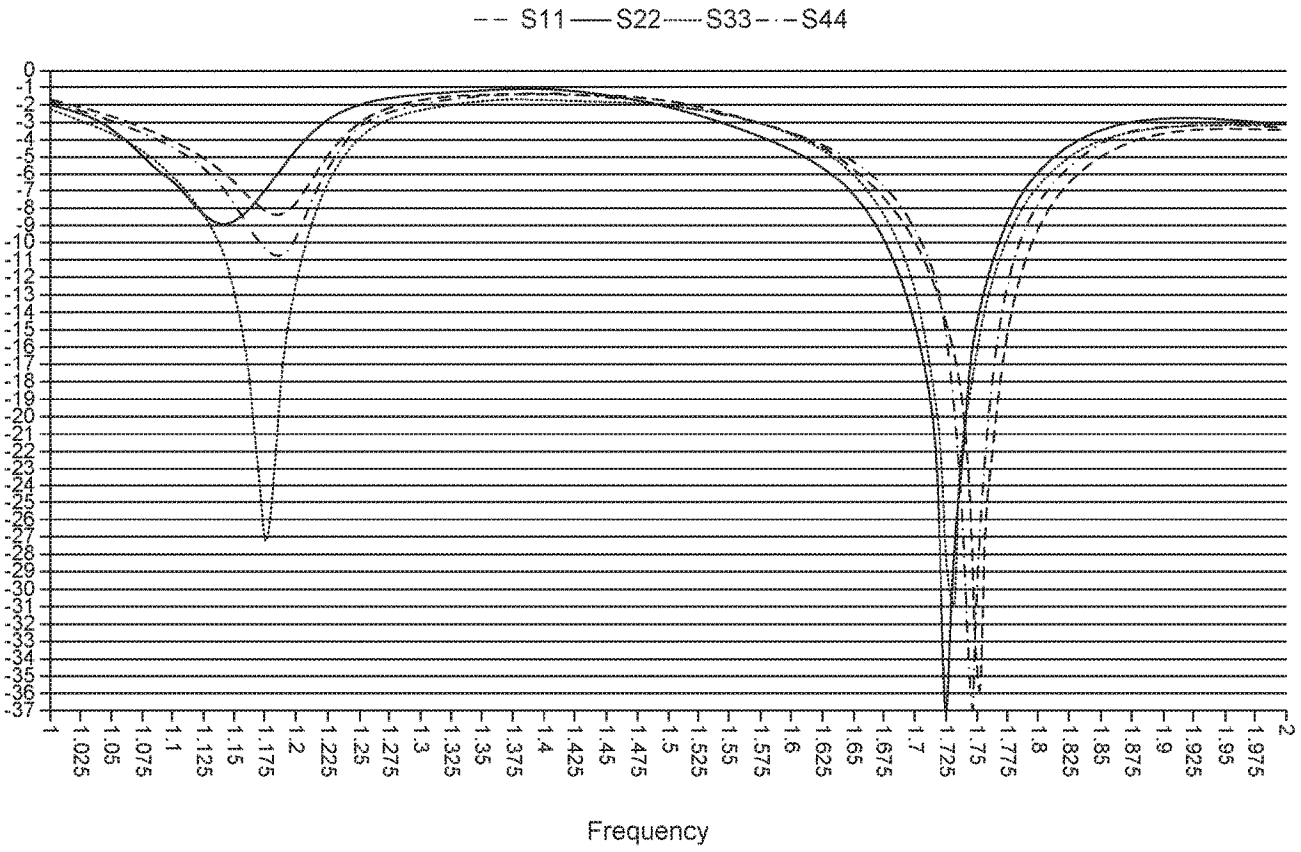
FIG. 7 shows an example Return Loss (S11) at each input port of the first antenna, according to an embodiment.

As a result of the thinner monopole, antenna B is able to achieve better gain coverage and bandwidth than antenna A. The measured circularly polarized gain patterns of antenna B are shown in FIGS. 5A-5D. FIG. 6 shows the gain at zenith for all GNSS and Iridium frequencies. The measured peak gain at L1 is 0.8 dBic and at Iridium it is 1.7 dBic. At L2 the gain is 1.4 dBic and at L5 it is 0.8 dBic. FIG. 7 shows the Return Loss (S11) at each input port of this QHA, the return loss is low which is shows a good impedance match. However, as shown in FIGS. 6 and 7, the best return loss and gain performance were obtained at a much higher frequency (approximately 1.75 GHz in FIG. 7). With additional tuning of antenna B, however, the high gain resonance may be moved closer to the L1 and Iridium frequency.

When a monopole, sleeve monopole, dipole or other antenna is co-located with the QHA, the QHA performance is similar to the results shown here. Moreover, the QHA can be re-optimized with a slight re-tuning of its capacitance to compensate for the removal of the monopole, sleeve monopole, dipole, or other antenna.

Antenna B provides better size-performance tradeoff for GNSS and Iridium than the prior art in QHA and folded QHAs.

The prior art in folded or wideband QHAs includes the following designs, none of which provide the above-described benefits of antenna systems described herein, and none of which include capacitances or shorts to adjacent folded arms, and none of which include co-locating a monopole antenna within a QHA and having those two antennas share a ground plane.

The QHA antenna system described in McCarrick, *A Combination Monopole/Quadrifilar Helix Antenna for S-band Terrestrial Satellite Applications,* Microwave Journal, p. 330, May 1, 2001, does not include two co-located antennas that are coupled to the same ground plane and does not include a capacitance or a short to other folded arms.

The QHA antenna system described in U.S. Pat. No. 6,483,471 to Petros does not include capacitances or shorts to adjacent folded arms. Moreover, the '471 Patent does not describe co-locating a monopole antenna within a QHA and having those two antennas share a ground plane.

The QHA antenna system described in U.S. Pat. No. 6,621,458 to Petros et al. does not include capacitances or shorts to adjacent arms. Moreover, the linearly polarized antenna described in the '458 Patent is not co-located with a QHA.

The QHAs reported in Letestu, Y., A. Shariha, *Broadband Folded Printed Quadrifilar Helix Antenna,* IEEE Transactions on Antennas & Propagation, Vol. AP-54, n. 5, May 2006, pp. 1600-1604 and U.S. Patent Application Publication No. 2006/125712 to Sharaiha et al. is relatively large QHA. It is 34×127 mm (1.34"×5.0") and does not cover the L5 frequency band. It does not include capacitances or shorts to adjacent folded arms. Moreover, it does not describe co-locating a monopole antenna within a QHA and having those two antennas share a ground plane.

The QHA in Rabemanantsoa and Sharaiha, *Size Reduced Multi-Band Printed Quadrifilar Helical Antenna,* IEEE Transactions on Antennas and Propagation v. 59, n. 9, pp. 3138-3143, September 2011, covers L1 and L5 frequencies only, not L2 or Iridium, and the size is 36×72 mm (1.42"×2.85") which is 42% wider than antenna B of Table I. It does not include capacitances or shorts to adjacent folded arms. Moreover, it does not describe co-locating a monopole antenna within a QHA and having those two antennas share a ground plane.

The QHA in Rabemanantsoa, J., A. Shariha, *Small-folded, Printed Quadrifilar Helix Antenna for GPS Applications,* 14$^{th}$ International Symposium on Antenna Technology and Applied Electromagnetics (ANTEM) and the American Electromagnetics Conference (AMEREM), 2010, is 36×78 mm (1.42"×3.07") and only covers the L1/L2 frequency bands, not L5 or Iridium. It does not include capacitances or shorts to adjacent folded arms. Moreover it does not describe co-locating a monopole antenna within a QHA and having those two antennas share a ground plane.

The QHA designs in Bhandari, B., S. Gao, and T. Brown, *Meandered Variable Pitch Angle Printed Quadrifilar Helix Antenna,* 2009 Loughborough Antenna and Propagation Conference, UK and A. Petros and S. Licul, *Folded Quadrifilar Helix Antenna,* IEEE Antennas and Propagation Symposium, v. 4., 2001, pp. 569-572, cover only one narrow frequency band. It does not include capacitances or shorts to adjacent folded arms. Moreover, it does not describe co-locating a monopole antenna within a QHA and having those two antennas share a ground plane.

A prior L1/L2 dual-band trap-loaded QHA described in Lamensdorf, D., M. Smolinski, *Dual-band Quadrifilar Helix Antenna,* IEEE Antennas and Propagation Symp 2002, v 3, pp. 488-91 and U.S. Pat. No. 6,653,987, to Lamensdorf et al., is relatively long (approximately 127 mm (5") long) and covers only L1 and L2 frequency bands. Moreover, U.S. Pat. No. 6,720,935 to Lamensdorf et al. describes a similar QHA, but also includes a patch antenna over a QHA. These antennas do not include capacitances or shorts to adjacent folded arms. Additionally, these antennas do not include a monopole antenna co-located with a QHA.

The antenna system described in U.S. Pat. No. 6,181,286 to Roscoe et al. does not describe a monopole antenna co-located within a QHA. It does not include capacitances or shorts to adjacent folded arms.

The antenna system described in U.S. Pat. No. 6,094,178 to Sanford does not include an antenna co-located with a QHA, but rather a QHA that is fed in two modes. It does not include capacitances or shorts to adjacent folded arms.

The antenna systems described in U.S. Pat. Nos. 6,407,720 and 6,133,891 (both to Josypenko) do not include shorts to adjacent arms or capacitances. Moreover it does not describe co-locating a monopole antenna within a QHA and having those two antennas share a ground plane.

Moreover, it is also not specifically stated in any of the above-referenced works whether the loss through the quad combiner is included in the reported gain or not.

The performance of a folded QHA antenna is substantially insensitive to the impedance between the base of the monopole and the handset case: whether open or short circuited or a small gap. Thus, it is not expected that this impedance will have a significant effect on the antenna's performance.

Electromagnetic computer modeling software was used to optimize antennas A,B,C, and D. Specifically, High Frequency Structure Simulator (HFSS) with the Distributed Solve Option from Ansys Corporation was used. The patterns computed using HFSS are similar to the measured patterns except the computed gain is about 2 to 4 dB higher near zenith than the measured gain. Only 2 dB of that discrepancy is due to quad combiner loss used to form the RHCP for the measurements. The remaining 0 to 2 dB discrepancy may be due to, for example, inaccuracies in the HFSS computer simulation, imperfections in the prototype construction, and measurement tolerances. The HFSS computed S11 curves show a double dip resonance as seen in the measured results in FIGS. 4 and 7, although the frequency can be shifted a little in the optimized computed curves. This may suggest that further improvements in performance are possible.

Antennas C and D were also computer modeled. They have a dielectric material with relative permittivity, $\varepsilon_r$, of 4. The computer models predicted coverage of GNSS and Iridium frequencies, with or without the thin UHF monopole. Due to the dielectric loading ($\varepsilon_r$=4.0) the bandwidth is narrower and coverage at L5 is lower gain than the larger air-loaded antenna results shown above. Other dielectric constants as high as 9 and 15 were also tried, but better results were obtained using the lower dielectric constants for these wideband designs.

C. Capacitance.

As shown in FIG. 1A, a capacitance 110 is provided between each helix driven arm 114 and its respective folded arm 116. Using capacitances 110 provides wider bandwidth coverage than a conventional QHA design. In an embodiment, this capacitance is produced by overlapping two copper traces, separated by Mylar polyester film to form a small parallel-plate capacitor. This can be a more reliable and repeatable method to include very small capacitances in the prototypes than soldering surface-mount capacitors by hand. This method of producing capacitance also allows the capacitance to be trimmed to tune the impedance match and to maximize the gain of the QHA at the desired frequencies. In an embodiment, the same capacitance can be used for each of the four helixes of the QHA.

In one embodiment, the desired capacitance is first estimated using HFSS modeling and then it is adjusted empirically by trimming the capacitor overlap length in the prototypes. For example, a capacitance of 0.4 pF can be used. The capacitance can improve antenna performance of the QHA or first antenna with or without the second antenna. That is, a capacitance can be used when the antenna system includes the first and second antennas, for example the QHA and monopole, or when only the first antenna is present, for example the QHA only without the monopole.

D. UHF Monopole

Figure 8:
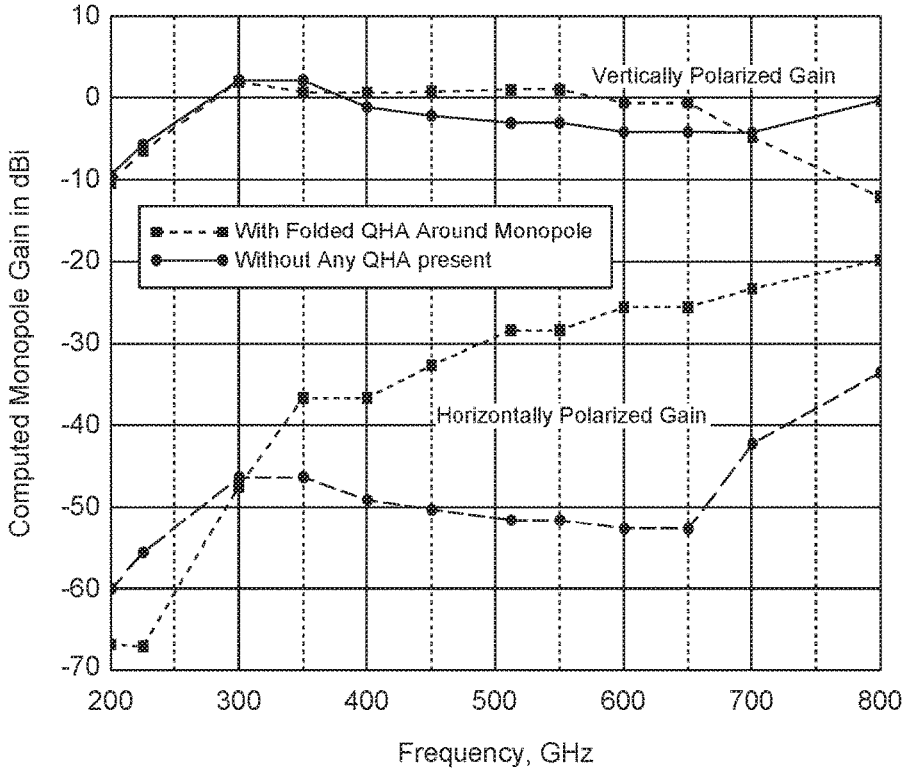
FIGS. 8 and 9 show an example computed gain at the horizon for a second antenna, according to an embodiment.
Figure 9:
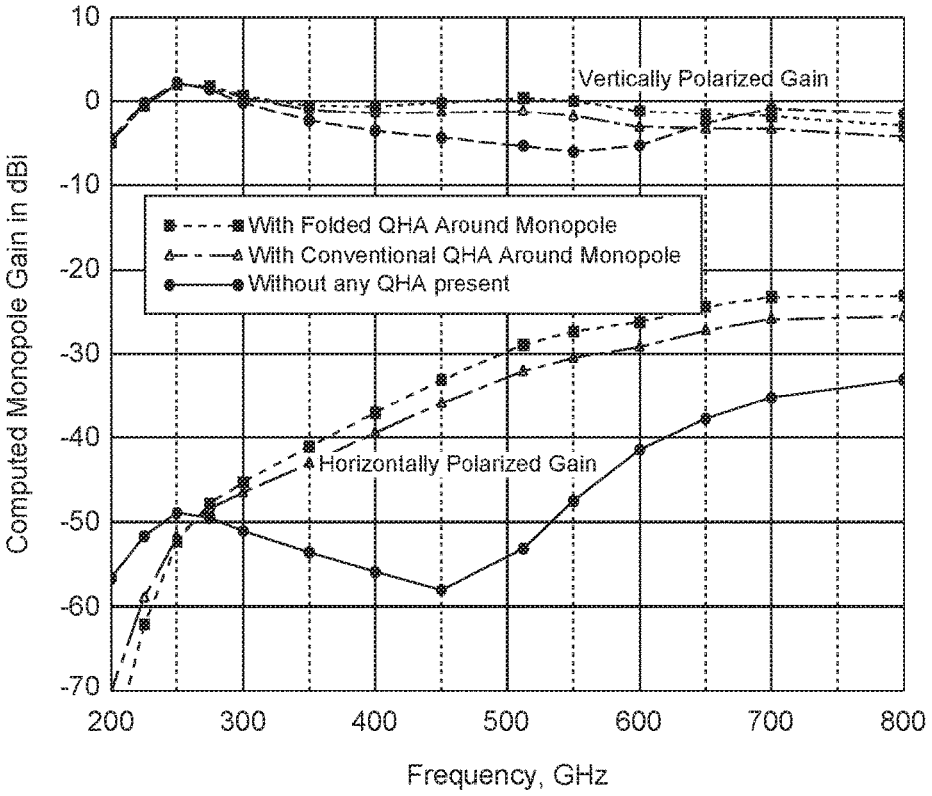

The performance of monopoles is well documented. See, e.g., Chen, To Tai, *Dipoles and Monopoles* in Antenna Engineering Handbook, Second Edition, editors: R. C. Johnson, H. Jasik, McGraw-Hill Book Co. 1984, Chapter 4; and also Rama-Rao, B. et al., *Ferrite Loaded UHF Sleeve Monopole Integrated with a GPS Patch Antenna for a Handset,* Microwave and Optical Technology Letters, Vol. 54, No. 11, pp. 2513-16, November 2012. To examine the effect of the QHA on thin UHF monopole performance, a 3.2 mm (0.125") diameter vertical monopole was computer modeled using HFSS on the handset with and without the QHA. FIGS. 8 and 9 show computed monopole gain at the horizon. No earth or human body was included in the simulation. FIGS. 8 and 9 show that the presence of the QHA increases the monopole gain by several dB towards the horizon for most of the UHF communications band. This is due to improved impedance match for the UHF monopole. The isolation between the UHF monopole and QHA ports was also computed and is about −45 dB at GNSS frequencies.

VII. Conclusion

The foregoing description of the specific embodiments will so fully reveal the general nature of the invention that others can, by applying knowledge within the skill of the art, readily modify and/or adapt for various applications such specific embodiments, without undue experimentation, without departing from the general concept of the present invention. Therefore, such adaptations and modifications are intended to be within the meaning and range of equivalents of the disclosed embodiments, based on the teaching and guidance presented herein. It is to be understood that the phraseology or terminology herein is for the purpose of description and not of limitation, such that the terminology or phraseology of the present specification is to be interpreted by the skilled artisan in light of the teachings and guidance.

The breadth and scope of the present invention should not be limited by any of the above-described exemplary embodiments, but should be defined only in accordance with the following claims and their equivalents.

What is claimed is:

1. A helical antenna, comprising:

a rod; and radiating elements helically wrapped around the rod, wherein:

each of the radiating elements comprises a driven arm and a folded arm; and the folded arm of a first one of the radiating elements comprises a first end and a second end, the first end being coupled to a ground plane and the second end being short-circuited to the driven arm of a second one of the radiating elements.

2. The helical antenna of claim 1, wherein the driven arm of the second one of the radiating elements comprises a third end and a fourth end, the third end being coupled to a feed point and the fourth end being short-circuited to the second end of the folded arm of the first one of the radiating elements.

3. The helical antenna of claim 1, wherein the second end of the folded arm of the first one of the radiating elements is coupled to the driven arm of the first one of the radiating elements through a capacitor.

4. The helical antenna of claim 3, wherein the capacitor comprises overlapping metal traces.

5. The helical antenna of claim 3, wherein the capacitor is configured to increase a gain of the helical antenna at a desired frequency.

6. The helical antenna of claim 1, wherein the rod comprises a dielectric rod or a foam rod.

7. The helical antenna of claim 1, wherein the folded arm and the driven arm of at least one of the radiating elements comprise metal traces.

8. The helical antenna of claim 1, wherein the radiating elements comprise two radiating elements.

9. The helical antenna of claim 1, wherein the radiating elements comprise four radiating elements.

10. The helical antenna of claim 1, wherein the helical antenna is configured to operate in a 1164-1300 MHz frequency band or a 1559-1626 MHz frequency band.

11. A helical antenna, comprising:

a dielectric rod; and first and second radiating elements helically wrapped around the dielectric rod, wherein:

each of the first and second radiating elements comprises a driven arm and a folded arm;

first ends of the folded arms of the first and second radiating element are coupled to a ground plane; and second ends of the folded arms of the first and second radiating elements are short-circuited to the driven arms of the second and first radiating elements, respectively.

12. The helical antenna of claim 11, wherein:

first ends of the driven arms of the first and second radiating elements are short-circuited to the second ends of the folded arms of the second and first radiating elements, respectively; and second ends of the driven arms of the first and second radiating elements are coupled to respective feed points.

13. The helical antenna of claim 11, wherein the second ends of the folded arms of the first and second radiating elements are coupled to the driven arms of the first and second radiating elements, respectively, through a capacitor, wherein the capacitor is configured to maximize a gain of the helical antenna at a desired frequency.

14. The helical antenna of claim 11, wherein the driven arms of the first and second radiating elements are coupled to respective feed points.

15. The helical antenna of claim 11, wherein the helical antenna is configured to operate in a 1164-1300 MHz frequency band or a 1559-1626 MHz frequency band.

16. A helical antenna, comprising:

first and second radiating elements helically arranged around a vertical axis of the helical antenna, wherein:

each of the first and second radiating elements comprises a driven arm, a folded arm, and a capacitor;

a first end of the folded arm of the first radiating element is coupled to a ground plane; and a second end of the folded arm of the first radiating element is short-circuited to the driven arm of the second radiating element.

17. The helical antenna of claim 16, wherein the second end of the folded arm of the first radiating element is coupled to the driven arm of the first radiating element through the capacitor of the first radiating element.

18. The helical antenna of claim 16, wherein the driven arms of the first and second radiating elements are coupled to respective feed points.

19. The helical antenna of claim 16, wherein each of the driven arm, the folded arm, and the capacitor comprises metal traces.

20. The helical antenna of claim 16, wherein the helical antenna is configured to operate in a 1164-1300 MHz frequency band or a 1559-1626 MHz frequency band.

* * * * *